United States Patent [19]

Deasy

[11] Patent Number: 4,652,888

[45] Date of Patent: Mar. 24, 1987

[54] MINIATURE TACTICAL HF ANTENNA

[75] Inventor: Richard E. Deasy, Cedar Rapids, Iowa

[73] Assignee: Rockwell International Corporation, El Segundo, Calif.

[21] Appl. No.: 553,667

[22] Filed: Nov. 21, 1983

Related U.S. Application Data

[63] Continuation-in-part of Ser. No. 376,871, May 10, 1982, Pat. No. 4,511,900.

[51] Int. Cl.[4] ..... H01Q 11/14

[52] U.S. Cl. ..... 343/791; 343/842; 343/845

[58] Field of Search ..... 343/739, 790, 791, 846, 343/842, 845

[56] References Cited

U.S. PATENT DOCUMENTS 3,151,327 9/1964 Levy et al. ..... 343/791

3,761,940 9/1973 Hollingsworth ..... 343/830

4,161,736 7/1979 Goodman ..... 343/739

4,400,702 8/1983 Tanaka ..... 343/790

*Primary Examiner*—Eli Lieberman

*Attorney, Agent, or Firm*—M. Lee Murrah; George A. Montanye; H. Fredrick Hamann

[57] ABSTRACT

An improved miniature antenna is disclosed which provides an electrically short radiation pattern by providing shielding of selected portions of a current carrying conductor forming a loop antenna. The shielding is provided so that the shielded portion of the loop antenna does not cancel the radiation from an unshielded radiating portion of the antenna, thereby producing a uniform radiation pattern. A plurality of the current carrying elements formed by the shielded and unshielded portions may be coupled in a series and parallel relationship to provide optimum impedance matching at the frequency of operation of a transmitter or receiver.

8 Claims, 7 Drawing Figures

FIG 1
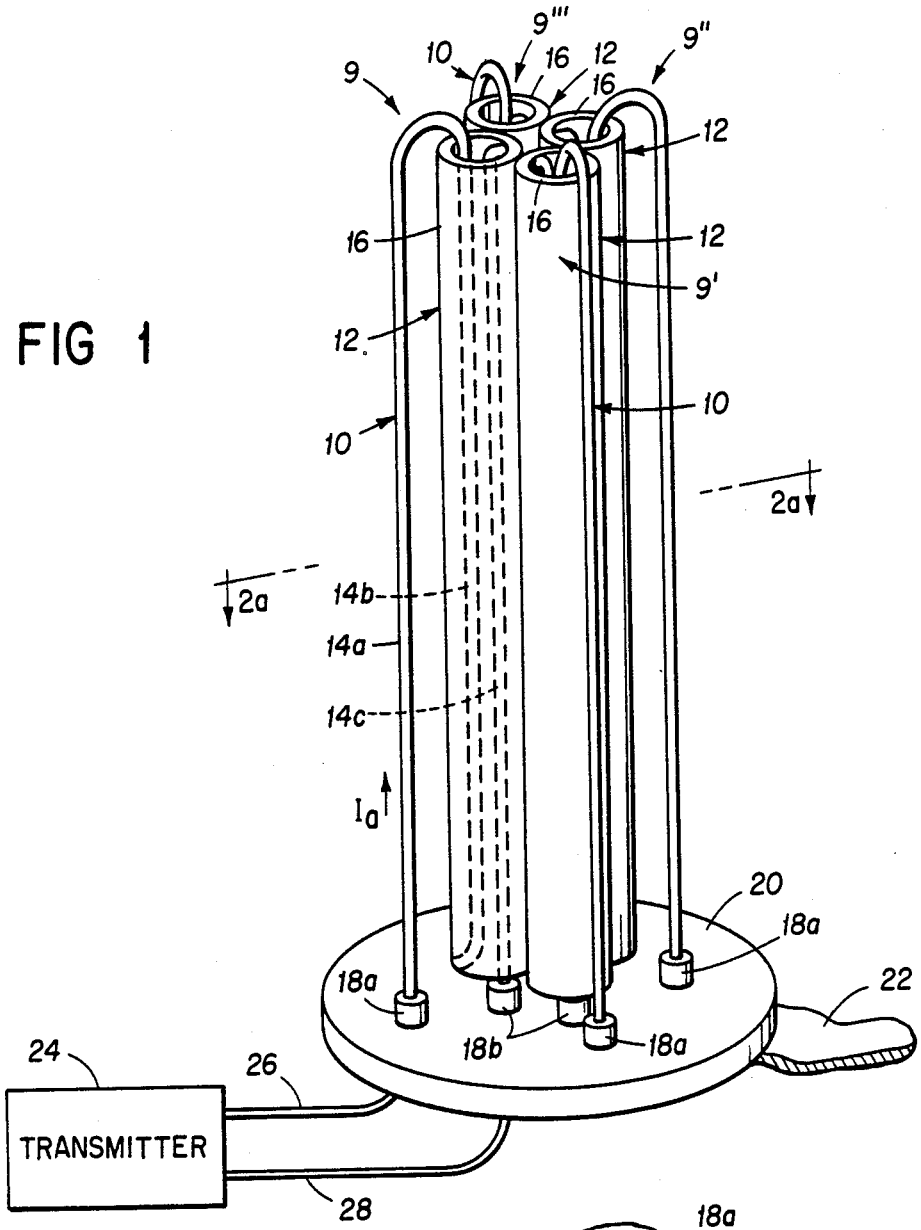
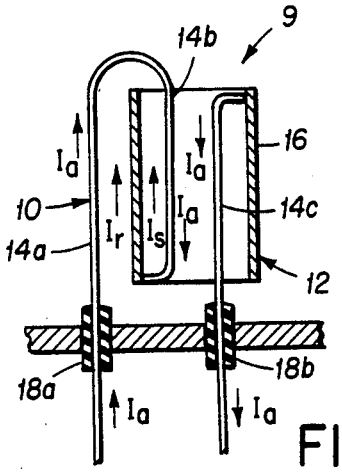
FIG 2b
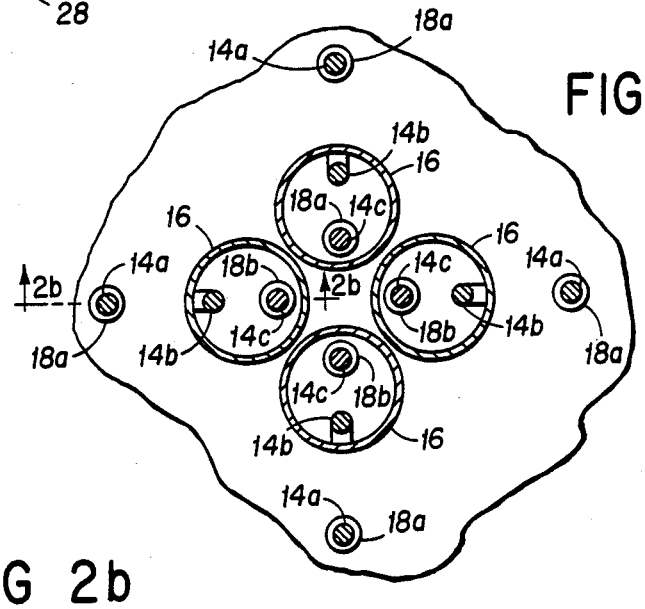
FIG 2a

MINIATURE TACTICAL HF ANTENNA

The present invention is a continuation-in-part application of co-pending U.S. application Ser. No. 376,871 filed on May 10, 1982 entitled "Current Enhanced Monopole Radiation Type Antenna Apparatus" now U.S. Pat. No. 4,511,900 by Richard E. Deasy and assigned to the same assignee as the present application.

BACKGROUND OF THE INVENTION

The present invention relates to antennas, and more particularly, to miniature antennas that operate within the high frequency range and with relatively large signal currents.

In the prior art, short monopole antennas are used in a variety of circumstances to produce omni-directional low angle radiation patterns. Such antennas, however, require high voltage to produce the necessary current flow and characteristically have a high driving point impedance. Capacitive top loading may be employed to reduce the high voltage, lower the antenna impedance, and increase current, but the same is implemented at the expense of a more complex and larger antenna configuration which becomes limited in use and versatility. Since the generation of high voltages create problems related to efficiency, shielding, and insulation of such antennas, there is a need in many environments for a monopole antenna which can utilize low voltages yet still be provided in a configuration having compact design.

In the aforementioned co-pending application which is herein incorporated by reference in its entirety, a current enhanced monopole radiation type antenna is disclosed which overcomes many of the above-noted limitations. In particular, the application discloses a monopole and dipole antenna formed by creating an antenna from a loop current carrying conductor which has an unshielded radiating portion and a shielded non-radiating portion. A single loop forming a monopole antenna or plural loops forming dipole antennas may be coupled in accordance with the teachings in the aforementioned application to produce enhanced radiation which utilizes lower voltages in a more compact configuration. It has been discovered, however, that although the antenna constructed in accordance with the above-noted teachings produces an improved structure over prior art antennas, there is still a need for further improvements in the particular techniques of shielding and to enable operation of the antenna over a variety of frequency ranges. One example of the recognized need for such shielding and examples of problems associated therewith may be found with reference to the article "Antennas for Nonsinusoidal Waves", published in *IEEE Transactions on Electromagnetic Compatibility,* Vol. EMC-25, No. 1, Feb. 1983.

Accordingly, the present invention has been developed to overcome the specific shortcomings of the above known and similar techniques and to provide an improved miniaturized high frequency antenna.

SUMMARY OF THE INVENTION

In accordance with the present invention, an antenna is formed which employs at least one current carrying conductor which has a section forming an unshielded radiating portion and a section which serves as both a shield for internal current carrying conductive portions and a radiating portion. The current carrying conductor is formed as a loop antenna with a special shielding structure to provide the radiation pattern of a short monopole antenna. In another embodiment of the invention, a plurality of the current carrying conductors may be coupled in series/parallel configurations to match the impedance of a transmitter over a wide band of frequency ranges. In addition, the current carrying conductors may be arranged to form a dipole antenna or other antenna configuration which may also be configured and coupled to produce impedance matching over a wide frequency range.

It is therefore a feature of the present invention to provide an improved monopole radiation type antenna.

It is another feature of the invention to provide an antenna which may interface with a standard high frequency transmitter/receiver to provide impedance matching over its range of operating frequency.

It is yet another feature of the invention to provide an antenna with enhanced efficiency for narrow band transmission and reception.

It is still a further feature of the invention to provide an antenna that includes a plurality of current carrying conductors having radiating sections and shielded sections which are intercoupled to provide optimum impedance matching at the frequency of transmission or reception.

It is still another feature of the invention to provide an antenna in which the radiating elements may be arranged in series, in parallel, or in series/parallel combinations to provide optimum antenna lengths for the frequency of transmission or reception.

It is still yet another feature of the invention to provide a miniature antenna which has enhanced broadband impedance characteristics resulting from the selection of lengths of radiating elements for the operating frequency.

It is a still further feature of the invention to provide an antenna which employs a configuration for shielding a portion of a conductive element to provide improved monopole radiation which is capable of operating over a wide range of frequencies.

These and other advantages and novel features of the invention will become apparent from the following detailed description when considered with the accompanying drawings wherein:

BRIEF DESCRIPTION OF THE DRAWINGS

FIG. 1 is a multielement closed loop transmission line antenna configured in a monopole radiation pattern;

FIG. 2*a* is a top sectional view of the multielement closed loop transmission line antenna taken along the line 2*a*—2*a* in FIG. 1;

FIG. 2*b* is a side sectional view of a portion of the multielement closed loop transmission line antenna of FIG. 1 taken along the line 2*b*—2*b* in FIG. 2*a;*

DETAILED DESCRIPTION OF A PREFERRED EMBODIMENT

Figure 3:
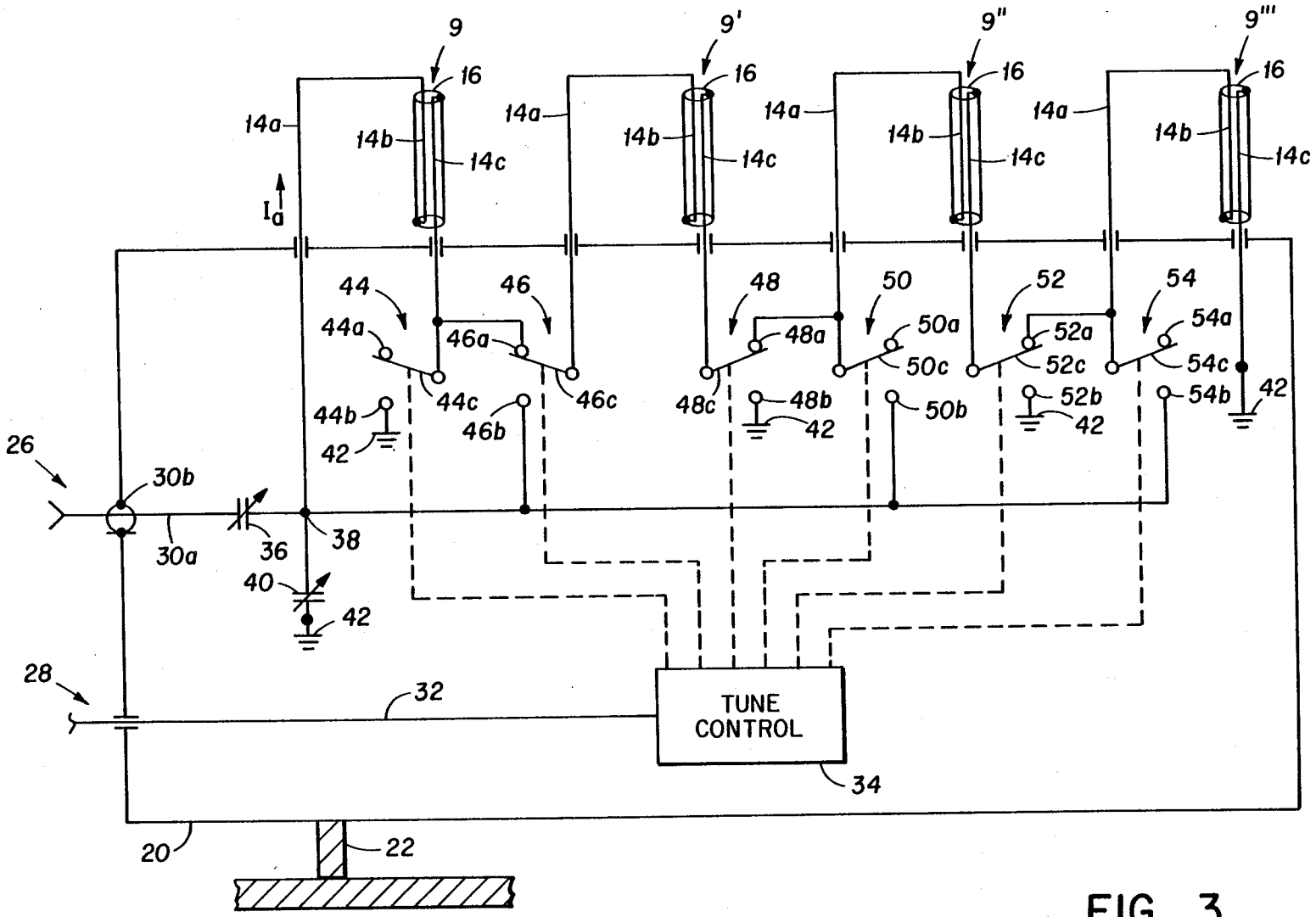
FIG. 3 is a schematic diagram of an antenna tuning control for the embodiment of FIG. 1.

Referring now to the drawings, wherein like numerals refer to like elements throughout, there is shown in FIG. 1 an antenna formed by a plurality of identical electrically closed, loop antenna elements 9–9''' (FIG. 2b). Each closed loop element includes a section 10 and a section 12. The section 10 generally forms an unshielded radiating portion while the shielded section 12 serves as a shield for internal current carrying conductive portions and as a radiating portion. Each antenna element 9–9''' includes a current carrying conductor having a first conductor portion 14a which generally forms the unshielded radiating portion of section 10 and a second conductor portion 14b which is looped and extends within and lengthwise through a conductive housing open at both ends and formed, for example, by a metal tube 16 or equivalent structure. The conductor portion 14b is generally spaced from and parallel to the inside wall of tube 16 for the length of the tube, but is electrically coupled, as by soldering, etc., to the inside wall of that tube adjacent the opening at the lower end as shown in FIG. 1. A third conductor portion 14c is electrically coupled in the same manner as 14b to the internal wall of the tube 16 at the opposite end of conductor portion 14b and also extends the length of the tube parallel to the conductor portion 14b to exit at the lower end of tube 16 as shown in FIG. 1. The conductor portion 14c is likewise spaced parallel to the inside of the tube 16.

An end of each of the conductor portions 14a and 14b extends through cylindrical insulators 18a and 18b, respectively, in an electrically conductive base 20 to electrically isolate the conductor portions 14a and 14b from the base 20 and to mount the elements forming the closed loop in a generally vertical position with respect to the base 20. The base 20 is in turn connected to a ground system through a grounding strap or portion 22 to form an exterior ground in any conventional manner. In FIG. 1, the antenna is formed as a plurality of the above-described combination of antenna elements 9–9''' to produce a short monopole antenna. The plurality of elements 9–9''' are mounted in a symmetrical relationship about an axis which extends perpendicular to the base 20 centrally between each of the tubes 16 to form an antenna which may be impedance matched to the transmitter, receiver or transceiver as will be described in more detail below. Although reference will be made throughout to the use of the system with a transmitter, it is to be understood that reference to transmitter is meant to include receiver and transceiver as well.

The antenna elements 9–9''' are coupled to a transmitter 24 by an electrical RF (radio frequency) transmission line 26 as more particularly shown in FIG. 3. Also, the transmitter 24 is coupled to provide tuning information for impedance matching of the antenna elements 9–9''' through electrical control cable 28 coupled to circuitry within the base 20 of the antenna configuration. When the antenna is tuned, RF power at line 26 is converted to antenna current Ia at the resonant frequency. Typically, the electrical coupling line 26 may be a coaxial conductor having an inner conductor 30a and an outer conductor 30b as shown in FIG. 3. The line 28 may also comprise any conventional electrical coupling through portion 32 to provide tuning control information to a tuning circuit 34 as will be described hereinafter.

Each electrically closed loop antenna element formed by sections 10 and 12 produces a current enhanced monopole antenna configuration similar in concept to that described in the aforementioned co-pending application, but provides improved shielding and current enhancement for a significant improvement in the current feed. As described in the aforementioned co-pending application, the purpose of a shielding section is to allow generation of an antenna radiation pattern by current flow in the unshielded section so the antenna will provide the antenna radiation without significant subtraction by currents generated in the remainder of the closed loop. If the current conductor were a single line without any such shielding, the radiation produced by currents generated in one portion of the loop would be opposite to the radiation produced by currents in another portion of the loop, thereby producing the type of cancellation associated with a small loop antenna which results in directional nulls in antenna transmission or reception.

The structure of the aforementioned co-pending application is directed to a technique to prevent such subtraction by shielding and produces improved results over what was previously available in the prior art. However, the present configuration is designed to further improve such current isolation. In terms of the monopole antenna elements formed by sections 10 and 12 in FIG. 1, if the primary current for antenna radiation is produced by an upward flow of the current in conductor portion 14a in FIG. 1, the goal of the shielding structure is to minimize the radiation from downward current (current flowing in an opposite direction to the primary current) in the antenna system. If the primary antenna current flowing in conductor portion 14a in the electrically closed loops is designated as Ia and is shown as moving in the upward direction as illustrated in FIGS. 1 and 2b, then the same current Ia must flow in a downward direction out of conductor 14c to complete the loop as shown in FIG. 2b. However, the portion of antenna current flowing on the outside of tube 16, as part of the section 12, also produces radiation which is added to that radiation produced by the flow of current Ia in conductor portion 14a. Therefore, If the current flowing on the outside of the tube 16 is designated as Ir and the remainder of the primary current Ia which flows on the inside of the tube 16 is designated as Is, then Ia can be defined as:

$$Ia = Is + Ir$$

In accordance with the present configuration, radiation is produced by upward flowing current Ia in the conductor portion 14a as well as by upward flowing antenna current Ir flowing on the outside of tube 16 to thereby provide current enhancement in the system. The upward flowing current Is is within the shield (tube 16) and does not produce significant radiation. The shield tube 16 also prevents significant radiation from the downward flowing current (Ia) in conductor portions 14b and 14c. The proposed configuration prevents direct flow of primary current from shield structure to the groundplane, and the tube 16 is constructed to provide a maximum shielding of the downward currents flowing on the inner conductors 14b and 14c.

In accordance with the above description, the configuration of sections 10 and 12 can be utilized in a manner similar to that described in connection with the aforementioned co-pending application to provide single element monopole antennas and dual element dipole antennas. However, in accordance with a further aspect of the present invention, there is a need to provide antenna configurations which enable broadband impedance matching at the high frequencies at which the transmitter 24 may be operated. Using only single antenna elements, impedance matching over all of the bands at which the transmitter 24 may operate is difficult and may only normally be achieved with complex circuitry, adding to the cost and expense of the system. Accordingly, the present structure has been designed to enable impedance matching of the transmitter 24 in a simplified and less costly manner while limiting the size of the antenna structure to enable a more compact configuration to be maintained.

Referring particularly to FIG. 3, each of the electrically closed loop antenna elements 9–9''' are electrically coupled as shown. In this instance, the input from coupling line 26 provides the RF power for generating antenna radiation wherein the inner conductor 30*a* is coupled through tuning capacitor 36 to a node 38 which in turn is coupled to one terminal of a tuning capacitor 40 having a second terminal coupled to an internal ground 42 of the antenna system. Electrical conductor portion 14*a* of antenna element 9 is coupled to the node 38 while the conductor portion 14*c* of antenna element 9''' is connected to the internal ground 42. Each of the remaining conductor portions 14*a* and 14*c* of the elements 9–9''' are coupled to contacts of relays 44, 46, 48, 50, 52 and 54 as shown.

In accordance with the present invention, the relays 44, 46, 48, 50, 52 and 54 are coupled in such a manner that the electrical length of the antenna formed by antenna elements 9–9''' can be varied to simplify matching of the impedance of the antenna to the transmitter 24 by capacitors 36 and 40 for the particular band of operating frequencies. The electrical length of the antenna may be varied with the structure shown in FIG. 3 by a series connection or parallel connection, or both, of each of the four elements 9–9'''. This series/parallel coupling is provided by the aforementioned relays which may be operated by a conventional tuning control circuit 34 to operate the relays to set their position in response to signals on line 32 defining the selected frequency band. Thereafter, the current flowing in the four antenna elements 9–9''' produce in-phase monopole omni-directional low angle radiation when the antenna is vertically oriented as shown in FIG. 1.

In the present example, capacitor 40 and relay contacts 44*b*, 48*b*, and 52*b* are all connected to the internal RF ground 42. Tuning of capacitors 36 and 40 produces current 1*a* flowing through the antenna element from node 38 to ground 42. This internal ground 42 is also connected to the external ground system 22 by means of the current paths around insulators 18*a* and 18*c*. The base 20 also forms a shielded enclosure for the electronic circuits, including the relays and tuning control 34 which are contained within the base 20. Relay contacts 46*b*, 50*b* and 54*b* are in turn connected to the node 38. The relay contacts 44*a*, 50*a* and 54*a* define a relay position forming an open circuit between the conductor portion 14*c* of the associated antenna element, while the relay contacts 46*a*, 48*a* and 52*a* provide an electrical connection between the conductor portion 14*c* of one antenna element and the conductor 14*a* of a successive antenna element, thereby forming a serial connection between two antenna elements when the relay switch contacts 46*c*, 48*c* and 52*c* are in the appropriate position.

As can be seen, by appropriately controlling the switch contacts 44*c*, 46*c*, 48*c*, 50*c*, 52*c* and 54*c* of each of the associated relays by a tuning control circuit 34, any combination of series/parallel connections of the antenna elements 9–9''' may be obtained to vary the effective antenna length and therefore its effective impedance. By way of example, the length of each antenna element 9 can be fixed at approximately one meter and the antenna formed by all elements 9–9''' (by utilizing a series/ parallel combination of the elements), can be set to simplify impedance matching over an operating frequency range of approximately 1.6–30 MHz. Note that impedance matching at the operating frequency of the associated radio is accomplished using capacitors 36 and 40 or an equivalent matching network in connection with the relay selected antenna length. This may be accomplished by setting the relay contacts 44*c*, 46*c*, 48*c*, 50*c*, 52*c* and 54*c* in a position to engage one of the other two associated relay contacts as shown in the following table which defines the desired frequency band in the three identified rows, and identifies the relays in the columns along with the position of the c relay contact with respect to the a and b relay contacts. It will be apparent that other series/parallel combinations could be used depending on the desired length of each antenna element as may be neecessary to produce different impedances for different bands of operation.

| | Relay contact c Position with respect to Relay contacts a and b for each relay | | | | | |
|---|---|---|---|---|---|---|
| Frequency Band | 44 | 46 | 48 | 50 | 52 | 54 |
| 1.6–5 MHz | to a | to a | to a | to a | to a | to a |
| 5–12 MHz | to a | to a | to b | to b | to a | to a |
| 12–30 MHz | to b | to b | to b | to b | to b | to b |

In addition to the above-noted bands, the above-described system may also be operated above 30 MHz by maintaining the parallel connection of the radiating elements 9–9''' as shown for the 12 to 30 MHz band. The transmitter 24 would be broadband matched from 30 MHz to approximately 90 MHz for a one meter antenna element length using a broadband matching network in lieu of the narrowband capacitors 36 and 40 shown.

As previously mentioned, capacitors 36 and 40 act provide a narrowband impedance match between the associated radio and the antenna. Capacitor 36 is a series phasing capacitor while capacitor 40 is a shunt loading or impedance magnitude changing capacitor. These capacitors are operated in a conventional antenna coupler manner to translate the complex impedance of the connected current carrying conductors to 50+jO ohms for the transmitter associated with the antenna. The tuning of these capacitors may be provided separately or coupled to the same tuning control 34 used to provide switch settings for each of the identified relays. Also, as was previously noted, the relays and circuit connections shown in FIG. 3, including the tuning control 34, are all maintained within a shielded enclosure formed by the base 20 connected to an external ground plane to provide complete RF shielding of the elements within the base 20.

Figure 4:
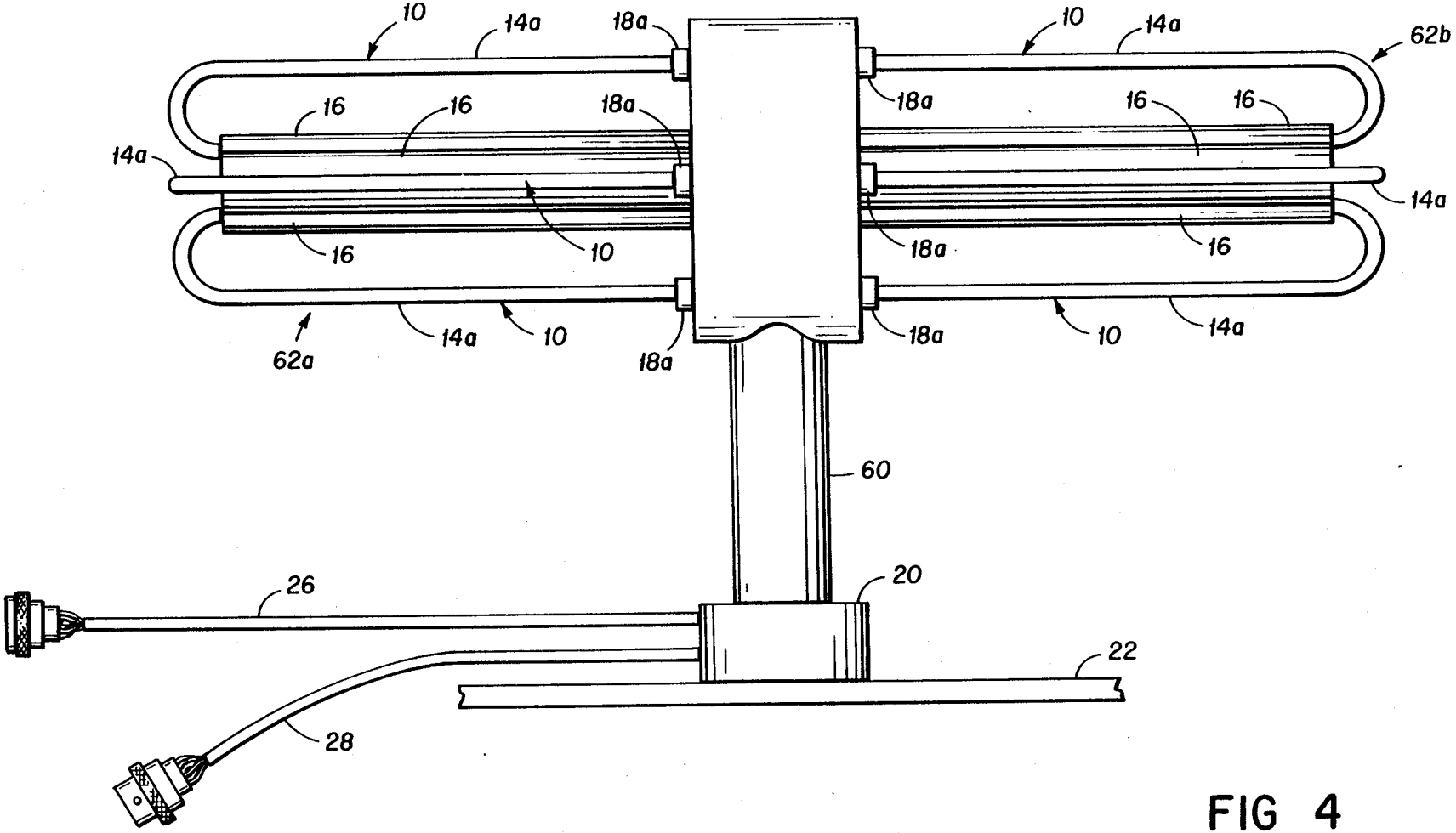
FIG. 4 is a representation of a configuration of a multielement closed loop transmission line configured to form a dipole antenna radiation pattern in accordance with the present invention.

Referring now to FIG. 4, there is shown an alternative embodiment constructed in accordance with the present invention wherein two antenna elements, each formed by sections 10 and 12, may be configured in line to form a dipole arrangement similar to that disclosed in the aforementioned co-pending application. The dipole may be placed in a vertical or horizontal attitude. The configuration of FIG. 4 is again constructed of a plurality of such antenna elements 9–9''' mounted on either side of a central post 60 to form two antenna sections 62*a* and 62*b* and maintain the antenna elements in line to form the dipole arrangement.

Figure 5:
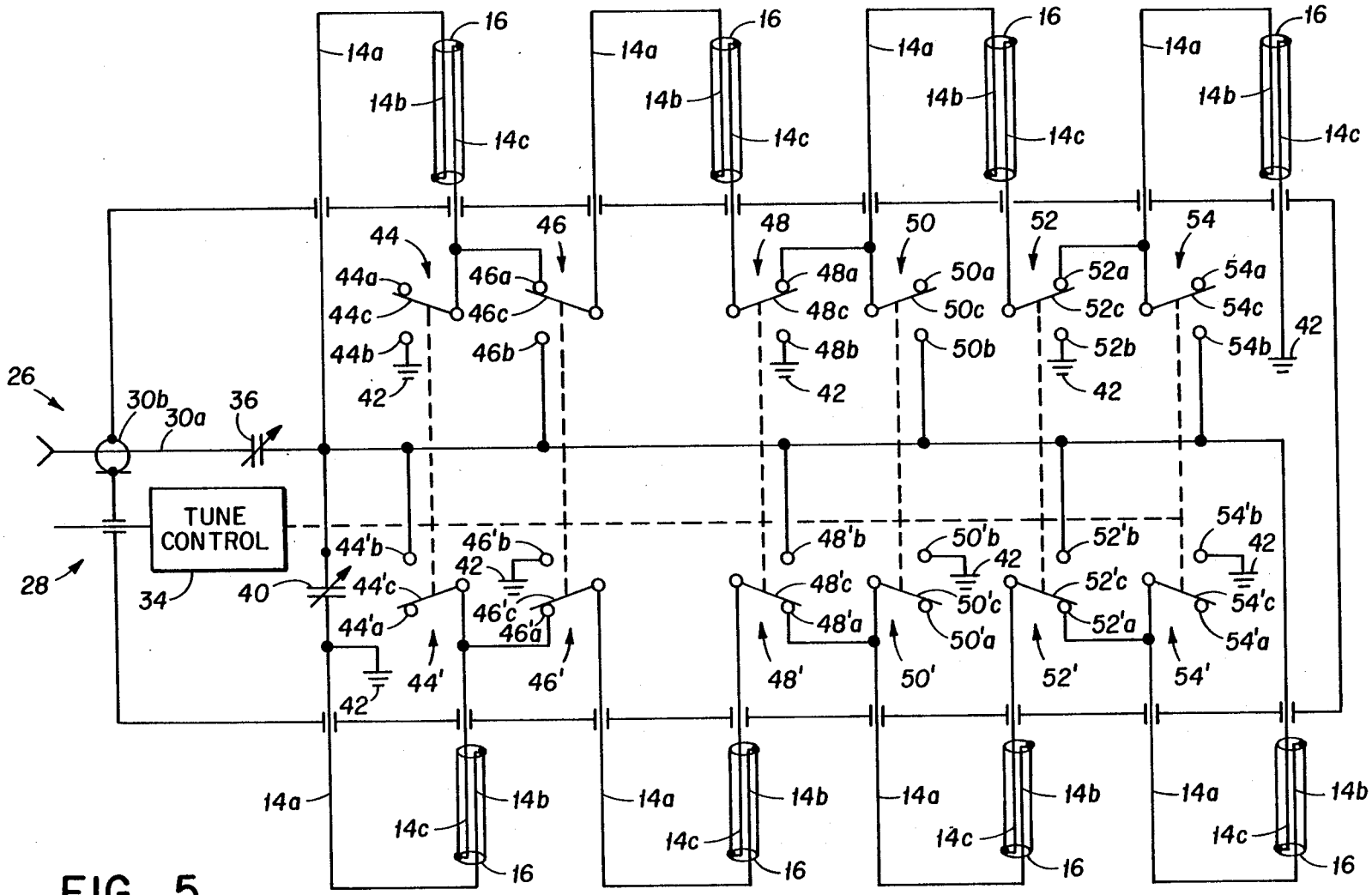
FIG. 5 is a schematic diagram of an antenna control for the dipole antenna depicted in FIG. 4.

In this instance, the same connections from the transmitter may be provided, as was noted with respect to FIG. 1 and identified by the same reference numerals. The wiring from the antenna elements is provided through conductive mast 60 (which may be a conductive tube) and thence to the base 20 which again houses the electronics as was noted with respect to FIG. 1. Accordingly, the operation and construction is similar and need not be described in greater detail except to refer to the detailed schematic of FIG. 5 showing the interconnection of the elements necessary to explain the coupling needed to impedance match the dipole arrangement. Again, in view of the description made with respect to FIG. 1, a detailed explanation of the embodiment of FIG. 5 is considered unnecessary to an understanding of its operation. In this instance, each of the relays for the antenna elements 9–9''' in section 62*a* on one side of the dipole is associated with a relay denoted by the same relay number designated as a prime for the antenna elements 9–9''' in section 62*b*, and are operated in conjunction with one another by the tuning control 34 to produce dipole radiation with different effective antenna lengths according to the prior noted table. The two antenna sections 62*a* and 62*b* positioned on either side of the mask 60 are thus coupled such that the current vectors of the currents that flow in each of the antennas are always in phase to produce dipole type radiation. The resulting structure then produces a radiation pattern that is that of an electrically small dipole antenna. This construction allows relatively high currents to be used to enhance antenna performance in contrast to those present in a standard (open-ended) electrically small dipole. As before, the capacitors 36 and 40 are used to provide the tuning of the dipole over the bands of frequency noted with respect to the previous table.

Figure 6:
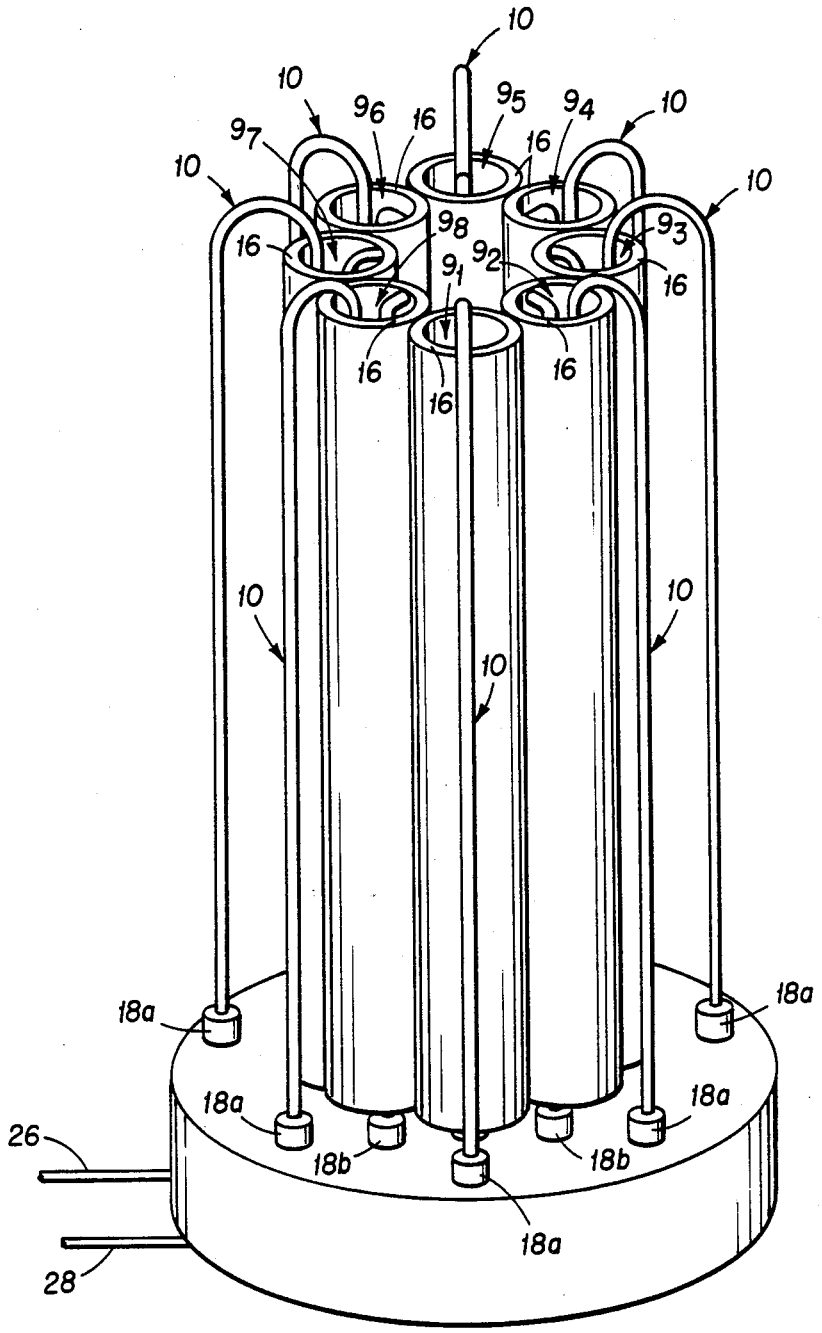
FIG. 6 is still another embodiment of a multielement closed loop transmission line antenna constructed in accordance with the present invention.

Referring now to FIG. 6, there is shown still another embodiment of the invention wherein a plurality of eight antenna elements $9_1$–$9_8$ are shown symmetrically oriented with respect to a central axis perpendicular to the base 20. The antenna elements $9_1$–$9_8$ in this embodiment are the same as those previously described with respect to FIG. 1 and provide additional elements allowing the production of an antenna pattern providing antenna operation over a wide band of frequencies. Each of the antenna elements $9_1$–$9_8$ may be coupled in the manner described with respect to FIG. 3 with the additional relays associated with the additional antenna elements to provide couplings capable of selecting different antenna lengths for different needs of impedance matching. This allows optimization of antenna size for different antenna applications to meet the impedance requirements over selected frequency bands. The arrangement of the relays will be apparent from an understanding of the description with respect to FIGS. 1 and 3 so that no further description is necessary for an understanding of its operation.

In the operation of any of the embodiments of the present invention, the conductor formed by portions 14*a*, 14*b*, and 14*c* must necessarily be a low-loss device in order to enhance the antenna efficiency for narrow band operation. This is so since the antenna is current-fed and at high currents must therefore have low losses associated with the conductors. It will similarly be appreciated that the separation of the conductor elements 14*a* from the support 20 and from one another is made to minimize excessive coupling to the shield structures. This arrangement enhances the generation of radiation by the current flow on the outside of the shield portions which add to the radiation from the unshielded portions. In this manner, a highly efficient current fed antenna can be constructed which provides improved antenna operation and performance over a wide band frequency range. Each of these are features which are not taught or suggested in the prior art.

While particular circuits and embodiments have been shown in describing the above invention, it is apparent that other circuits and configurations may be used to produce similar results. Accordingly, it is apparent that other obvious modifications and variations of the present invention are possible in light of the above teachings. It is therefore to be understood that within the scope of the appended claims, the invention may be practiced otherwise than as specifically described.

What is claimed is:

1. An antenna element comprising:

A first electrical conductor;

an electrically conductive tube having a first tube end and a second tube end;

a second electrical conductor having a first end extending along and within said tube from said first tube end to said second tube end, said first end of said second electrical conductor coupled to said first electrical conductor and said second end of said second electrical conductor coupled to said second tube end; and a third electrical conductor having a first end coupled to the first tube end and extending along and within said tube and spaced substantially parallel to said second electrical conductor and having a second end extending from said second tube end.

2. The element of claim 1 wherein said tube is cylindrical and has inner and outer walls and said second and third electrical conductors are spaced parallel to said inner wall.

3. A miniature antenna system comprising:

a plurality of antenna elements forming multiple closed loop transmission lines;

means for shielding a first portion of each of said plurality of antenna elements such that a second unshielded portion of each antenna element forms an antenna radiating and receiving portion for transmitting and receiving radio frequency radiation; and a plurality of relays coupled to selectively parallel and serially couple multiple ones of said closed loop transmission lines to alter the effective electrical length of the antenna formed by said closed loop transmission lines.

4. The system of claim 3 wherein said means for impedance matching further includes means for translating the impedance of said plurality of radiating and receiving portions to 50+jO ohms.

5. The system of claim 3 wherein each of said selected closed loop transmission lines are coupled to have a common coupling point for minimizing circulating currents.

6. The system of claim 3 wherein said antenna elements are configured to form an omnidirectional antenna.

7. An antenna system comprising:

a plurality of antenna elements forming multiple closed loop transmission lines, each of said antenna elements having a first unshielded section which includes a first electrical conductor having first and second ends, and a second shielded section wherein said unshielded section forms an antenna radiating and receiving portion for transmitting and receiving radio frequency radiation;

said second shielding section including;

an electrically conductive tubular member having first and second ends;

a second electrical conductor disposed within and extending through said tubular member and spaced therefrom and having a first end electrically coupled to the first end of said first conductor and a second end coupled to the second end of said tubular member;

a third electrical conductor disposed within and extending through said tubular member and spaced therefrom and having a first end coupled to the first end of said tubular member and a second end projecting from the second end of said tubular member; and means for coupling said plurality of closed loop transmission lines for impedance matching said antenna for selected frequency band of operation.

8. The antenna of claim 7 further comprising an electrically conductive base, said second ends of said first conductor and said third conductor extending through and electrically insulated from said base.

* * * * *